US009745873B2

(12) United States Patent
Hwang

(10) Patent No.: US 9,745,873 B2
(45) Date of Patent: Aug. 29, 2017

(54) MULTIPLE VARIABLE VALVE LIFT APPARATUS

(71) Applicant: HYUNDAI MOTOR COMPANY, Seoul (KR)

(72) Inventor: Gyu Han Hwang, Yongin-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 211 days.

(21) Appl. No.: 14/705,852

(22) Filed: May 6, 2015

(65) Prior Publication Data

US 2016/0160696 A1 Jun. 9, 2016

(30) Foreign Application Priority Data

Dec. 9, 2014 (KR) ..... 10-2014-0175833

(51) Int. Cl.

| | |
|---|---|
| ***F01L 1/34*** | (2006.01) |
| ***F01L 1/344*** | (2006.01) |
| ***F01L 1/047*** | (2006.01) |
| ***F01L 1/08*** | (2006.01) |
| ***F01L 13/00*** | (2006.01) |

(52) U.S. Cl.

CPC ..... *F01L 1/3442* (2013.01); *F01L 1/047* (2013.01); *F01L 1/08* (2013.01); *F01L 13/0005* (2013.01); *F01L 2001/34453* (2013.01); *F01L 2001/34483* (2013.01); *F01L 2013/001* (2013.01)

(58) Field of Classification Search

CPC . F01L 1/3442; F01L 1/047; F01L 1/08; F01L 13/0005; F01L 2001/34453; F01L 2013/001; F01L 2001/34483

See application file for complete search history.

(56) References Cited

U.S. PATENT DOCUMENTS

| | | | | |
|---|---|---|---|---|
| 7,909,007 | B2 * | 3/2011 | Manther | F01L 1/185 123/90.16 |
| 2007/0034184 | A1 * | 2/2007 | Dengler | F01L 1/08 123/90.17 |
| 2011/0197843 | A1 * | 8/2011 | Manther | F01L 1/185 123/90.45 |

FOREIGN PATENT DOCUMENTS

| | | | |
|---|---|---|---|
| JP | 2003-314312 | A | 11/2003 |
| KR | 10-2008-0055471 | A | 6/2008 |
| KR | 10-1080790 | B1 | 11/2011 |
| KR | 10-1448784 | B1 | 10/2014 |

* cited by examiner

*Primary Examiner* — Zelalem Eshete

(74) *Attorney, Agent, or Firm* — McDermott Will & Emery LLP

(57) ABSTRACT

A multiple variable valve lift apparatus includes a camshaft. At least two cam portions are disposed on an exterior circumference of the camshaft and including a high cam and a normal cam. A cylinder deactivation device is configured to perform a lever motion by one of the high cam or the normal cam and to be operated by hydraulic pressure. At least two lift operating portions are disposed on the exterior circumference of the camshaft and moving the cam portions in an axial direction of the camshaft. An operation control portion selectively moves the operating portions in the axial direction of the camshaft. A guide rail is formed in a groove of an exterior circumference of the lift operating portions into which a pin is inserted. The guide rail guides the pin according to rotation of the camshaft and the operating portions.

10 Claims, 3 Drawing Sheets

MULTIPLE VARIABLE VALVE LIFT APPARATUS

CROSS-REFERENCE TO RELATED APPLICATION

This application claims the benefit of priority to Korean Patent Application No. 10-2014-0175833 filed in the Korean Intellectual Property Office on Dec. 9, 2014, the entire content of which is incorporated herein by reference.

TECHNICAL FIELD

The present disclosure relates to a multiple variable valve lift apparatus. More particularly, the present disclosure relates to a multiple variable valve lift apparatus which varies lift of a valve by multiple steps.

BACKGROUND

An internal combustion engine receives fuel and air into a combustion chamber and generates power by combusting the fuel and the air. Intake and exhaust valves are operated by a camshaft. The air flows into the combustion chamber while the intake valve is open, and air is exhausted from the combustion chamber while the exhaust valve is open.

Optimal operations of the intake valve or the exhaust valve are determined according to a rotational speed of the engine. That is, lift and open/close timing of the valves are controlled according to the rotational speed of the engine. A variable valve lift (VVL) apparatus has been developed in which the valves are operated for various valve lifts according to the rotational speed of the engine for realizing optimal operations of the valves. For example, the VVL has a plurality of cams fastened to a camshaft and operating the valves with different valve lifts. The cams for operating the valves are selected according to a vehicle condition.

When the plurality of cams are provided to the camshaft, the operation of the intake valve or the exhaust valve by selectively changing the cams is complex, and interference between engine parts may occur.

Further, when the plurality of cams are independently operated to prevent the interference between the engine parts, an additional element is required for operating each cam, thus increasing cost.

The above information disclosed in this Background section is only for enhancement of understanding of the background of the disclosure, and therefore, it may contain information that does not form the prior art that is already known in this country to a person of ordinary skill in the art.

SUMMARY

The present disclosure has been made in an effort to provide a multiple variable valve lift apparatus having advantages of providing a simple composition and being efficiently operated without interference between constituent elements.

In addition, the present disclosure has been made in an effort to provide a multiple variable valve lift apparatus having advantages of reducing production cost.

Furthermore, the present disclosure has been made in an effort to provide a multiple variable valve lift apparatus having advantages of varying lift of a valve by at least three steps having zero lift for deactivating the cylinders.

A multiple variable valve lift apparatus according to an exemplary embodiment of the present inventive concept may include a camshaft rotating to open and close valves. At least two cam portions, which include a high cam and a normal cam, are disposed on an exterior circumference of the camshaft. The at least two cam portions move in an axial direction of the camshaft and rotate together with the camshaft. A cylinder deactivation device is connected to the valves and configured to perform a lever motion by one of the high cam or the normal cam. The cylinder deactivation device is operated by hydraulic pressure to selectively realize zero valve lift. At least two lift operating portions are disposed on an exterior circumference of the camshaft. The at least two lift operating portions move in the axial direction of the camshaft to move the at least two cam portions in the axial direction of the camshaft. An operation control portion selectively moves the at least two lift operating portions in the axial direction of the camshaft. A pin is attached to the operation control portion. A guide rail is formed in a groove of an exterior circumference of each the lift operating portions, such that the pin is inserted into the guide rail to guide the pin as the camshaft and the at least two lift operating portions rotate and to move the at least two lift operating portions in the axial direction of the camshaft by the pin. The at least two lift operating portions move according to the pin of the operation control portion.

The cylinder deactivation device may perform the lever motion by one of the high cam and the normal cam to vary valve lift and to select one of high lift and normal lift according to the at least two cam portions which move in the axial direction of the camshaft.

The cylinder deactivation device may include an outer body selectively performing the lever motion by one of the high cam and the normal cam around a rotational axis at one end of the outer body and connected to the valves at another end of the outer body. An inner body is disposed inside the outer body and having one end thereof is rotatably connected to the other end of the outer body. A connecting shaft penetrates the other end of the outer body and the one end of the inner body and connects the outer body with the inner body. A lost motion spring returns the inner body, which rotates with the outer body around the connecting shaft, to an initial position. The inner body may be fixed to the outer body to perform the lever motion together the outer body around the rotational axis of the outer body lever motion by the rotation of the normal or high by releasing the hydraulic pressure of the cylinder deactivation device. The inner body may be released from the outer body by the hydraulic pressure of the cylinder deactivation device such that only the inner body performs the lever motion around the connecting shaft by rotation of the normal or high cam.

The inner body may include a latching pin hole into which a latching pin is inserted and the outer body includes a latching spring and pushing the latching pin in one direction to fix the outer body to the inner body when the hydraulic pressure of the cylinder deactivation device is released. The latching pin may be pushed in the opposite direction by the hydraulic pressure to release the inner body from the outer body when the hydraulic pressure is supplied to the cylinder deactivation device.

The outer body may perform the lever motion together the inner body by the high cam which is selected according to the movement of the at least two cam portions in the axial direction of the camshaft to realize high valve lift. The outer body may perform the lever motion together the inner body by the normal cam which is selected according to the movement of the at least two cam portions in the axial direction of the camshaft to realize normal valve lift of the valve is realized. Only the inner body may perform the lever motion around the connecting shaft to realize the zero valve lift.

DETAILED DESCRIPTION OF THE EMBODIMENTS

An exemplary embodiment of the present inventive concept will hereinafter be described in detail with reference to the accompanying drawings.

Figure 1:
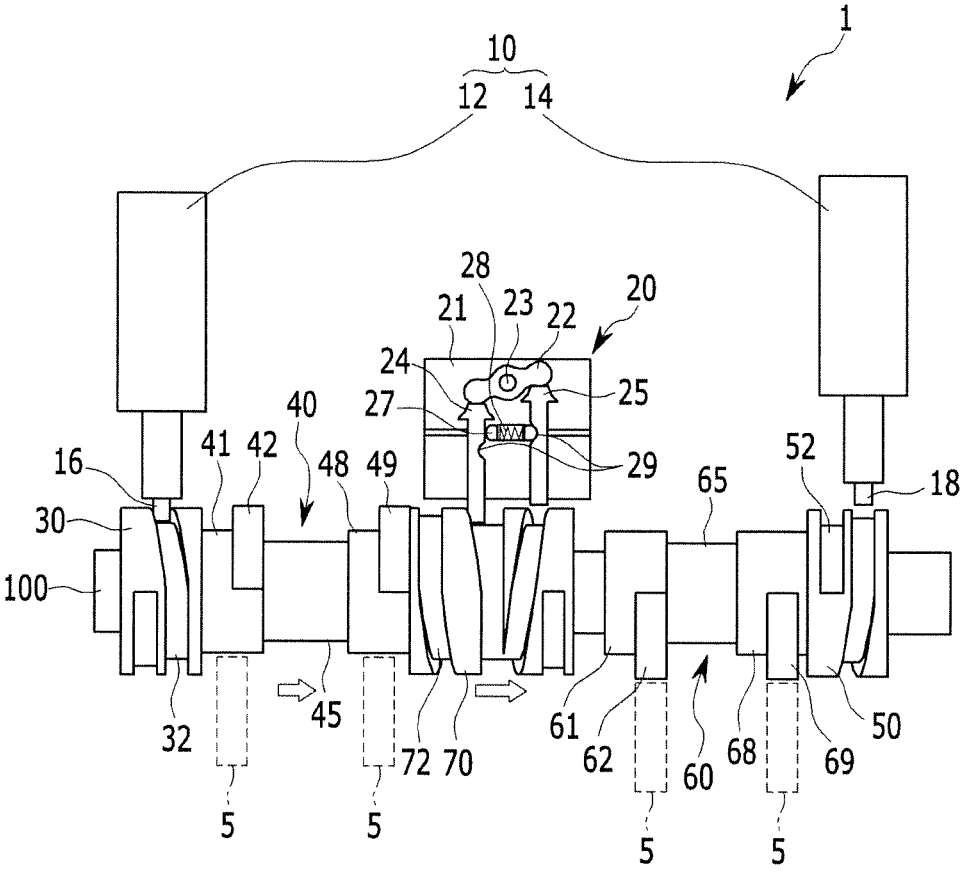
FIG. 1 is a schematic diagram of a multiple variable valve lift apparatus according to an exemplary embodiment of the present inventive concept.

FIG. 1 is a schematic diagram of a multiple variable valve lift apparatus according to an exemplary embodiment of the present inventive concept.

As shown in FIG. 1, a multiple variable valve lift apparatus 1 according to an exemplary embodiment of the present inventive concept includes a camshaft 100, cam portions 40 and 60, a solenoid 10, operators 30 and 50, an interlocker 70, and a pin operator 20. The operators 30 and 50 and the interlocker 70 are lift operating portions which operate to vary valve lift, and the solenoid 10 and the pin operator 20 control the operations of the operators 30 and 50 and the interlocker 70.

The camshaft 100 rotates according to rotation of a crankshaft (not shown) of an engine. The camshaft 100 is well-known to a person of an ordinary skill in the art, so a detailed description thereof will be omitted.

The cam portions 40 and 60 includes cams 41, 42, 48, 49, 61, 62, 68, and 69 for operating an intake valve (not shown) or an exhaust valve (not shown) of the engine and have in a hollow cylinder shape with a set thickness. The camshaft 100 is inserted into the cam portions 40 and 60. Therefore, the cam portions 40 and 60 protrude from an exterior circumference of the camshaft 100. The hollow of the cam portions 40 and 60 has a circle shape corresponding to the exterior circumference of the camshaft 100. That is, an interior circumference of the cam portions 40 and 60 is contacted to the exterior circumference of the camshaft 100. Furthermore, the interior circumference of the cam portions 40 and 60 is fitted on the exterior circumference of the camshaft 100 such that the cam portions 40 and 60 move in an axial direction of the camshaft 100. The cam portions 40 and 60 rotate together with the camshaft 100. The cam portions 40 and 60 are movable along the axis of the camshaft 100, and the cam portions 40 and 60 and the camshaft 10 are coupled to each other. Thus, the cam portions 40 and 60 and the camshaft 100 rotate together according to design of a person of ordinary skill in the art.

The cam portions 40 and 60 include a first cam portion 40 and a second cam portion 60. Herein, the first cam portion 40 operates a valve (not shown) disposed at one cylinder, and the second cam portion 60 operates a valve (not shown) disposed at another cylinder. Further, the first cam portion 40 can operate two valves disposed at the one cylinder, and the second cam portion 60 can operate two valves disposed the other cylinder.

In FIG. 1, the multiple variable valve lift apparatus 1 which operates a valve at two cylinders of a multi-cylinder engine having at least two cylinders (not shown) is shown. Herein, the valve is an intake valve or an exhaust valve.

The first cam portion 40 includes a first normal cam 41, a first high cam 42, a second normal cam 48, a second high cam 49, and a first connecting portion 45.

Each of the first normal cam 41, the first high cam 42, the second normal cam 48, and the second high cam 49 may be a general cam having an oval shape such that one end thereof protrudes further than another end thereof. Typically, the one end of the cam is called "cam lobe", and the other end of the cam is called "cam base".

Cam bases of the cams 41, 42, 48, and 49 have an arc shape with a uniform radius. Cam lobes of the cams 41, 42, 48, and 49 push a valve opening/closing unit 5 from when opening of the valve starts to when closing of the valve ends by the rotation of the cam 41, 42, 48, and 49. One end of the valve opening/closing unit 5 roll-contacts with the cams 41, 42, 48, and 49 so as to be operated to open/close the valves by the rotations of the cams 41, 42, 48, and 49. The valve opening/closing unit 5 is well-known to a person of an ordinary skill in the art such that a detailed description thereof will be omitted.

The first normal cam 41 and the first high cam 42 are disposed to be close to each other, and the second normal cam 48 and the second high cam 49 are disposed to be close to each other. In addition, the first normal cam 41 and the first high cam 42 are paired with each other so as to operate one valve, and the second normal cam 48 and the second high cam 49 are paired with each other so as to operate another valve.

The first connecting portion 45 connects the pair of the first normal cam 41 and the first high cam 42 with the pair of the second normal cam 48 and the second high cam 49. That is, the first connecting portion 45 is disposed between the pair of the first normal cam 41 and the first high cam 42 and the pair of the second normal cam 48 and the second high cam 49, and the first cam portion 40 is integrally molded.

The cam lobes of the first and second high cams 42 and 49 may further protrude from the exterior circumference of the camshaft 100 than the cam lobes of the first and second normal cams 41 and 48. Thus, the first and second high cams 42 and 49 realize high lift of the valve, and the first and normal cams 41 and 48 realize normal lift of the valve. That is, the high lift of the valve is realized when the valve opening/closing unit 5 roll-contacts the high cams 42 and 49, and the normal lift of the valve realized when the valve opening/closing unit 5 roll-contacts the normal cams 41 and 48. Furthermore, the first and second high cams 42 and 49 or the first and second normal cams 41 and 48 for operating the valve are selected according to the first cam portion 40 moving in the axial direction of the camshaft 100.

The second cam portion 60 includes a third normal cam 61, a third high cam 62, a fourth normal cam 68, a fourth high cam 69, and a second connecting portion 65.

Herein, the descriptions regarding the third normal cam 61, the third high cam 62, the fourth normal cam 68, the fourth high cam 69, and the second connecting portion 65 similar to the descriptions regarding the first normal cam 41, the first high cam 42, the second normal cam 48, the second high cam 49, and the first connecting portion 45, so will be omitted.

The solenoid 10 is provided so as to transform the rotational motion of the camshaft 100 to a rectilinear motion of the first cam portion 40 or the second cam portion 60.

That is, the first cam portion 40 or the second cam portion 60 rectilinearly moves in the axial direction of the camshaft 100 according to the rotational motion of the camshaft 100 as the solenoid 10 operates. Herein, the solenoid 10 operated to on or off by an electrical control the solenoid 10 is well-known to a person of an ordinary skill in the art such that a detailed description thereof will be omitted.

The operators 30 and 50 have a cylinder shape having a hollow similar to the first and second cam portions 40 and 60, through which the camshaft 100 is inserted such that the operators 30 and 50 are disposed on the exterior circumference of the camshaft 100. In addition, the operators 30 and have the hollow shape that the internal circumference of the operators 30 and 50 correspond with the external circumference of the camshaft 100. The external circumference of the operators 30 and 50 has a circle shape having uniform radius. Furthermore, the interior circumference of the operators 30 and 50 is fitted on the exterior circumference of the camshaft 100 such that the operators 30 and 50 move along the axis of the camshaft 100, and the operators 30 and 50 rotate together with the camshaft 100.

The solenoid 10 includes a normal lift solenoid 12 and a high lift solenoid 14, and the operators 30 and 50 include a normal lift operator 30 and a high lift operator 50.

The low lift operator 30 is integrally formed with the first cam portion 40 or moves together with the first cam portion 40. In addition, the normal lift operator 30 rotating together with the camshaft 100 moves in one direction in the axial direction of the camshaft 100 according to the operation of the normal lift solenoid 12. Thus, the normal lift of the valve is realized. While it is shown that the normal lift operator 30 is disposed at one end of the first normal cam 41 in FIG. 1, it is not limited thereto in the disclosed embodiment.

For better comprehension and convenience of description, a forward direction will be defined a word as the one direction that the normal lift operator 30 is moved for realizing the normal lift of the valve.

The high lift operator 50 is integrally formed with the second cam portion 60 or moves together with the second cam portion 60. In addition, the high lift operator 50 rotating together with the camshaft 100 moves in another direction along the axis of the camshaft 100 according to the operation of the high lift solenoid 14. Thus, the high lift of the valve is realized. While it is shown that the high lift operator 50 is disposed at one end of the third high cam 62 in FIG. 1, it is not limited thereto in the disclosed embodiment.

For better comprehension and convenience of description, a reverse direction will be defined a word as the other direction that the high lift operator 50 moves for realizing the high lift of the valve.

The interlocker 70 has a cylinder shape having a hollow therein like to the operators 30 and 50 and the first and second cam portions 40 and 60. The camshaft 100 is inserted into the hollow of the interlocker 70 such that the interlocker 70 is disposed on the exterior circumference of the camshaft 100. In addition, an internal circumference of the interlocker 70 corresponds to the external circumference of the camshaft 100. Further, an external circumference of the interlocker 70 has a circle shape having a uniform radius. Furthermore, an interior circumference of the interlocker 70 is fitted on the exterior circumference of the camshaft 100 such that the interlocker 70 moves along the axis of the camshaft 100, and the interlocker 70 rotates together with the camshaft 100.

The interlocker 70 is disposed between the integrally formed first cam portion 40 and the second cam portion 60. In addition, the interlocker 70 interlocks the first cam portion 40 and the second cam portion 60 with each other.

The interlocker 70 moves in a forward direction if the normal lift operator 30 moves in the forward direction. In addition, the integrally formed second cam portion 60 is pushed by the interlocker 70 according to the interlocker 70 moves in the forward direction. Thus, the second cam portion 60 moves in the forward direction.

The interlocker 70 moves in a reverse direction if the high lift operator 50 moves in the reverse direction. In addition, the integrally formed first cam portion 40 is pushed by the interlocker 70 according to the reverse movement of the interlocker 70. Thus, the first cam portion 40 moves in the reverse direction.

The pin operator 20 moves the interlocker 70 along the axis of the camshaft 100. In addition, the pin operator 20 includes a housing 21, a hinge unit 22, a first pin 24, a second pin 25, and a pin fixing unit 27.

The housing 21 is a case of the pin operator 20 that the hinge unit 22, the first pin 24, the second pin 25, and the pin fixing unit 27 are mounted thereto.

The hinge 22 performs hinge motion around a hinge shaft 23 mounted to the housing 21.

The first pin 24 and second pin 25 may have a bar shape which extends in one direction.

The first pin 24 is pushed by the hinge unit 22 according to the hinge motion of the hinge unit 22 such that the first pin 24 moves upwards and protrudes from the housing 21. In addition, the hinge unit 22 is pushed by the first pin 24 according to the original position of the first pin 24 such that the hinge unit 22 performs the opposite hinge motion. Further, the second pin 24 is pushed by the hinge unit 22 according to the opposite hinge motion of the hinge unit 22 such that the second pin 25 moves upwards and protrudes from the housing 21. That is, the pin operator 20 interlocks the first and second pins 24 and 25 with each other such that if one of the first pin 24 and the second pin 25 does not protrude from the housing 21, the other of the first pin 24 and the second pin 25 protrudes from the housing 21.

The pin fixing unit 27 fixes the position of the first and second pin 24 and 25 at the original position. A hooking groove 29 is formed at the first and second pin 24 and 25 for hooking the pin fixing unit 27 in which the first pin 24 or second pin 25 is positioned at the original position. The pin fixing unit 27 performs reciprocating motion between the first pin 24 and the second pin 25 such that a part of the pin fixing unit 27 is seated at the hooking groove 29 for fixing the first pin 24 and the second pin 25 at the original position.

The pin fixing unit 27 is operated by a spring 28. In addition, the pin fixing unit 27 is seated at the hooking groove 29 formed at the one of the first and second pins 24 and 25 by a relatively small force generated by the spring 28 and is disengaged from the hooking groove 29 by a relatively strong force generated by operation of the first and second pins 24 and 25. The hooking groove 29 and the part of pin fixing unit 27 contacted with the hooking groove 29 may have a gradually curved surface to easily operate.

The normal lift operator 30, the high lift operator 50, and the interlocker 70 include guide rails 32, 52, and 72.

The guide rail 72 of the interlocker 70 is in contact with the first pin 24 or the second pin 25 protruding from the housing 21 by the operation of the pin fixing unit 27 and the guide motion of the interlocker 70. That is, when the camshaft 100 rotates while the first pin 24 or second pin 25 is inserted into the guide rail 72 of the interlocker 70, the interlocker 70 moves along the axis of the camshaft 100 according to the guide rail 72 guiding the relative movement of the first pin 24 or second pin 25 with the rotation of the interlocker 70, such that the first pin 24 or second pin 25 moves along the exterior circumference of the interlocker 70.

The normal lift solenoid 12 includes a connecting pin 16 protruding in a bar shape and contacting the guide rail 32 of the normal lift operator 30 according the operation of the normal lift solenoid 12. In addition, the guide rail 32 of the normal lift operator 30 is in contact with the connecting pin 16 and guides the motion of the normal lift operator 30. That is, when the camshaft 100 rotates while the connecting pin 16 is inserted into the guide rail 32 of the normal lift operator 30, the normal lift operator 30 moves in the forward direction along the axis of the camshaft 100 according to the guide rail 32 guiding the relative movement of the connecting pin 16 with the rotation of the normal lift operator 30, such that the connecting pin 16 moves along the exterior circumference of the normal lift operator 30.

The high lift solenoid 14 includes a connecting pin 18 protruding in a bar shape and contacting the guide rail 52 of the high lift operator 50 according to the operation of the high lift solenoid 14. In addition, the guide rail 52 of the high lift operator 50 is in contact with the connecting pin 18 and guides the motion of the high lift operator 50. That is, when the camshaft 100 rotates while the connecting pin 18 is inserted into the guide rail 52 of the high lift operator 50, the high lift operator 50 moves in the reverse direction along the axis of the camshaft 100 according to the guide rail 52 guiding the relative movement of the connecting pin 18 with the rotation of the high lift operator 50, such that the connecting pin 18 moves along the exterior circumference of the high lift operator 50.

The guide rails 32, 52, and 72 may have a groove shape recessed from the exterior circumferences of the operators 30 and 50 and the interlocker 70. In addition, the groove shape guide rails 32, 52, and 72 are longitudinally formed along the circumference of the operators 30 and 50 and the interlocker 70.

Figure 2:
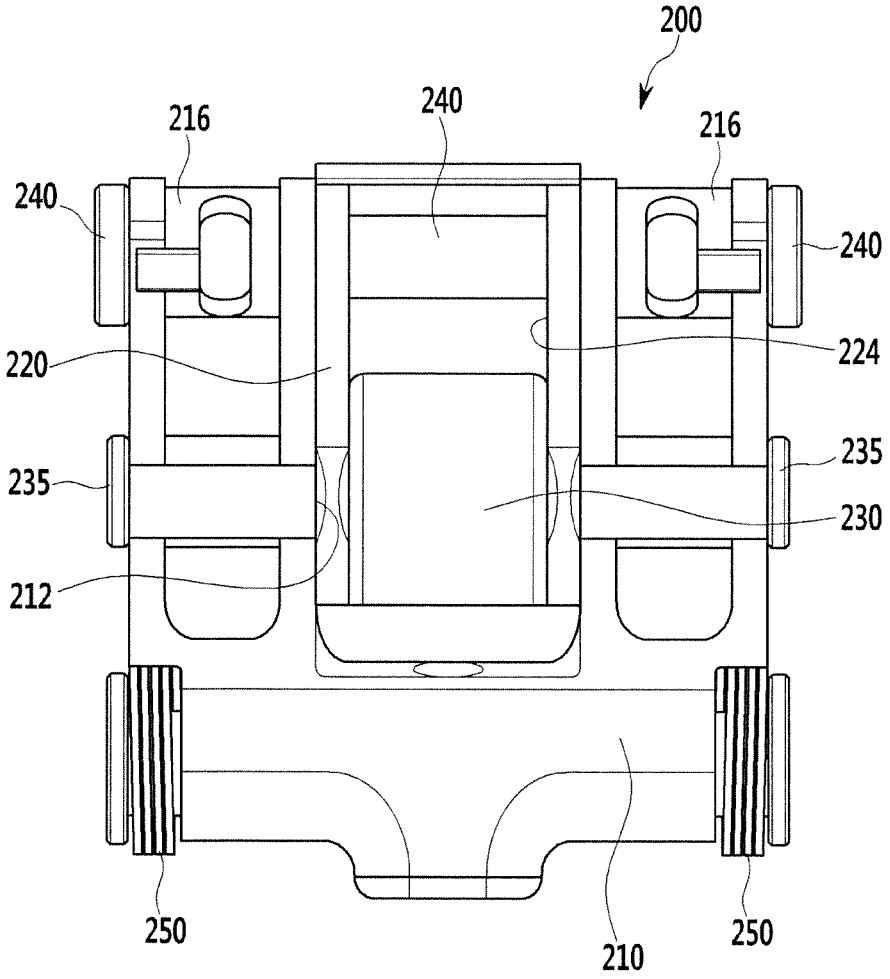
FIG. 2 is a top plan view of a cylinder deactivation device according to an exemplary embodiment of the present inventive concept.

FIG. 2 is a top plan view of a cylinder deactivation device according to an exemplary embodiment of the present inventive concept.

As shown in FIG. 2, a cylinder deactivation device 200 according to an exemplary embodiment of the present inventive concept includes an outer body 210, an inner body 220, a roller 230, a connecting shaft 240, and a lost motion spring 250.

The outer body 210 performs a lever motion by selectively receiving torque of a camshaft (not shown), and opens/closes a valve. In addition, a cam (not shown) is disposed at the camshaft so as to transform rotational motion of the camshaft to lever motion of the outer body 210. Herein, the valve is an intake valve or an exhaust valve of an engine. Further, a space 212 through which the outer body 210 is penetrated in a vertical direction is formed inside the outer body 210. That is, the outer body 210 has a set length so as to make a lever motion, and has a set width and a set thickness so as to form the inside space 212 of the outer body 210.

The valve is connected to one end of the outer body 210, and a rotational axis of the lever motion is disposed at another end thereof.

While it is shown that the inside space 212 of the outer body 210 is opened toward the one end of the outer body 210 in FIG. 2, it is not limited thereto.

In description hereinafter, ends of each element are connected to or disposed at the outer body 210 mean a portion on the same side with the one end and the other end of the outer body 210.

The inner body 220 is disposed in the inside space 212 of the outer body 210. In addition, one end of the inner body 220 is rotatably connected with the one end of the outer body 210. Further, the inner body 220 makes the lever motion by receiving torque of a camshaft (not shown), and selectively opens/closes a valve. Furthermore, a space 224 through which the inner body 220 is penetrated in the vertical direction is formed inside of the inner body 220. That is, the inner body 220 has a set length so as to make the lever motion, and has a set width and a set thickness so as to form the inside space 224 of the inner body 220.

The roller 230 is disposed in the inside space 224 of the inner body 220. In addition, the roller 230 is rotatably connected with the inner body 220. Further, a roller rotation shaft 235 rotatably connects the roller 230 with the inner body 220. That is, the roller 230 rotates around the roller rotation shaft 235. Furthermore, the roller 230 roll-contacts with the cam so as to transform the rotational motion of the camshaft to the lever motion of the outer body 210 or the inner body 220.

A valve contact portion 216 is disposed at the one end of the outer body 210. In addition, the valve contact portion 216, which contacts the valve, pushes the valve according to the lever motion of the outer body 210.

The inner body 220 is selectively fixed to the outer body 210 so as to make the lever motion together therewith or is selectively released from the outer body 210 so as to independently perform the lever motion.

When the inner body 220 is released form the outer body 210, the lost motion spring 250 returns the inner body 220 with the outer body 210 by the independent lever motion.

Figure 3:
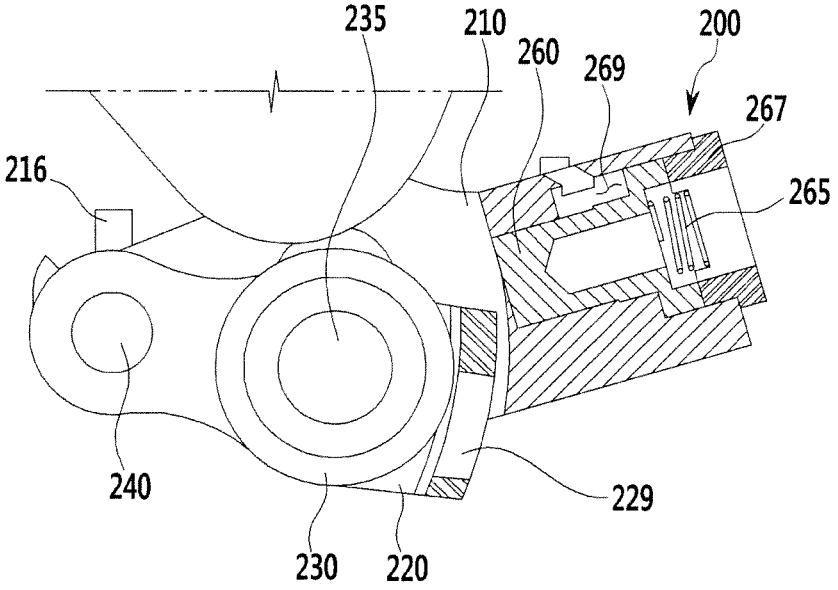
FIG. 3 is a cross-sectional side view of the cylinder deactivation device according to the exemplary embodiment of the present inventive concept.

FIG. 3 is a cross-sectional side view of a cylinder deactivation device according to an exemplary embodiment of the present inventive concept.

As shown in FIG. 3, the inner body 220 further includes a latching pin hole 229, and the outer body 210 includes a latching pin 260, a stopper 267, and a latching spring 265.

The latching pin hole 229 is formed such that the latching pin 260 is inserted thereinto. The latching pin 260 is operated by hydraulic pressure, and may be disposed at the other end of the outer body 210 for receiving hydraulic pressure. A hydraulic lash adjuster (HLA) for supplying hydraulic pressure may be mounted to the other end of the outer body 210.

The stopper 267 prevents the latching pin 260 from being escaped toward the other end of the outer body 210.

The latching pin 260 is inserted into the latching pin hole 229 by elastic force of the latching spring 265 such that the inner body 220 may be fixed to the outer body 210. That is, the latching spring 265 is disposed between the stopper 267 and the latching pin 260, such that one end of the latching spring 265 pushes the latching pin 260 toward the inner body 220. In addition, a hydraulic pressure chamber 269 which is surrounded by the outer body 210 and the latching pin 260 is formed at one end of the latching pin 260. Further, the latching pin 260 is pushed toward the other end of the outer body 210 by the hydraulic pressure supplied to the hydraulic pressure chamber 269, such that the inner body 220 is released from the outer body 210. In other words, the latching pin 260 returns by the latching spring 265 so as to be inserted into the latching pin hole 229 such that the inner body 220 is fixed to the outer body 210 when the hydraulic pressure supplied to the hydraulic pressure chamber 269 is released.

When the inner body 220 is fixed to the outer body 210, the inner body 220 and the outer body 210 performs the lever motion together around a rotational axis of the outer body 210 by the rotation of the cam which roll-contacts the roller 230. In addition, only the inner body 220 makes the lever motion around the connecting shaft 240 by the rotation of the cam when the inner body 220 is released from the outer body 210.

Herein, zero lift of the valve may be realized for performing deactivation of a cylinder if the cylinder deactivation device 200 is applied as the valve opening/closing unit 5.

In detail, the valve lift is realized by the normal lift or the high lift selected according to the operation of the multiple variable valve lift apparatus 1 in case that the outer body 210 makes the lever motion together with the inner body 220, and the valve lift is realized by the zero lift when only the inner body 220 makes the lever motion.

According to an exemplary embodiment of the present inventive concept, the multiple variable valve lift apparatus 1 can have simple composition and operate efficiently as the pin operator 20 and the interlocker 70, which moves along axial direction of the camshaft 100 by the operation of the pin operator 20, are provided.

In addition, interference between constituent elements can prevented as the cam portions 40 and 60, which are respectively disposed at each cylinder, are operated step by step by the interlocker 70.

Further, spatial utility can be improved and cost can be simultaneously reduced as the number of the solenoids 10 is minimized.

Furthermore, the zero lift of the valve may be realized as the cylinder deactivation device 200 is applied to the valve opening/closing unit 5.

While this inventive concept has been described in connection with what is presently considered to be practical exemplary embodiments, it is to be understood that the inventive concept is not limited to the disclosed embodiments, but on the contrary, is intended to cover various modifications and equivalent arrangements included within the spirit and scope of the appended claims.

What is claimed is:

1. A multiple variable valve lift apparatus, comprising:

a camshaft rotating to open and close valves;

at least two cam portions disposed on an exterior circumference of the camshaft and including a high cam and a normal cam, the at least two cam portions moving in an axial direction of the camshaft and rotating together with the camshaft;

a cylinder deactivation device connected to the valves and configured to perform a lever motion by one of the high cam or the normal cam, the cylinder deactivation device being operated by hydraulic pressure to selectively realize zero valve lift;

at least two lift operating portions disposed on an exterior circumference of the camshaft, the at least two operating portions moving in the axial direction of the camshaft to move the at least two cam portions in the axial direction of the camshaft;

an operation control portion selectively moving the at least two lift operating portions in the axial direction of the camshaft;

a pin attached to the operation control portion; and a guide rail formed in a groove of an exterior circumference of each of the operating portions, such that the pin is inserted into the guide rail to guide the pin as the camshaft and the at least two lift operating portions rotate and to move the at least two lift operating portions in the axial direction of the camshaft by the pin, wherein the at least two lift operating portions move according to the pin of the operation control portion, wherein the operation control portion includes a solenoid and a pin operator, and wherein the pin operator includes a housing, a hinge unit, a first pin, a second pin, and a pin fixing unit.

2. The apparatus of claim 1, wherein the cylinder deactivation device performs the lever motion by one of the high cam and the normal cam to vary valve lift and to select one of high lift and normal lift according to the at least two cam portions which move in the axial direction of the camshaft.

3. The apparatus of claim 1, the cylinder deactivation device comprising:

an outer body selectively performing the lever motion by one of the high cam and the normal cam around a rotational axis at one end of the outer body and connected to the valves at another end of the outer body;

an inner body disposed inside the outer body and having one end thereof rotatably connected to the other end of the outer body;

a connecting shaft penetrating the other end of the outer body and the one end of the inner body and connecting the outer body with the inner body; and a lost motion spring configured to return the inner body which rotates with the outer body around the connecting shaft to an initial position.

4. The apparatus of claim 3, wherein the inner body is fixed to the outer body to perform the lever motion together with the outer body around the rotational axis of the outer body by the rotation of the normal or high cam by releasing the hydraulic pressure of the cylinder deactivation device, and the inner body is released from the outer body by the hydraulic pressure of the cylinder deactivation device such that only the inner body performs the lever motion around the connecting shaft by the rotation of the normal or high cam.

5. The apparatus of claim 4, wherein the inner body includes a latching pin hole into which a latching pin is inserted and the outer body includes a latching spring and pushing the latching pin in one direction to fix the outer body to the inner body when the hydraulic pressure of the cylinder deactivation device is released, and wherein the latching pin is pushed in the opposite direction by the hydraulic pressure to release the inner body from the outer body when the hydraulic pressure is supplied to the cylinder deactivation device.

6. The apparatus of claim 4, wherein the outer body performs the lever motion together with the inner body by the high cam which is selected according to the movement of the at least two cam portions in the axial direction of the camshaft to realize high valve lift.

7. The apparatus of claim 4, wherein the outer body performs the lever motion together with the inner body by the normal cam which is selected according to the movement of the at least two cam portions in the axial direction of the camshaft to realize normal valve lift.

8. The apparatus of claim 4, wherein only the inner body performs the lever motion around the connecting shaft to realize the zero valve lift.

9. The apparatus of claim 1, wherein the at least two lift operating portions include lift operators and an interlocker.

10. The apparatus of claim 3, the cylinder deactivation device further comprising:

a roller disposed inside and rotatably connected with the inner body;

a roller rotation shaft connecting the roller and the inner body so that the roller rotates around the roller rotation shaft;

a valve contact portion formed at the one end of the outer body and pushing the valves according to the lever motion of the outer body;

a hydraulic pressure chamber formed inside the outer body.

* * * * *